US006615738B2

(12) United States Patent
Lecume

(10) Patent No.: US 6,615,738 B2
(45) Date of Patent: Sep. 9, 2003

(54) FRAGMENTATION EXPLOSIVE MUNITION ELEMENT

(75) Inventor: Serge Lecume, Mennecy (FR)

(73) Assignee: SNPE, Paris (FR)

( * ) Notice: Subject to any disclaimer, the term of this patent is extended or adjusted under 35 U.S.C. 154(b) by 0 days.

(21) Appl. No.: 10/036,365

(22) Filed: Jan. 7, 2002

(65) Prior Publication Data

US 2002/0096080 A1 Jul. 25, 2002

(30) Foreign Application Priority Data

Jan. 19, 2001 (FR) ..... 01 00740

(51) Int. Cl.[7] ..... F42B 12/22
(52) U.S. Cl. ..... 102/491; 102/473; 102/492
(58) Field of Search ..... 102/473, 305, 102/475, 491–497, 499

(56) References Cited

U.S. PATENT DOCUMENTS 3,714,897 A * 2/1973 Parker ..... 102/492
3,820,461 A 6/1974 Silvia
4,216,720 A * 8/1980 Kempton ..... 102/494
4,579,059 A 4/1986 Flatau ..... 102/503
4,662,281 A 5/1987 Wilhelm et al. ..... 102/494
4,781,117 A * 11/1988 Garnett et al. ..... 102/493
5,544,589 A * 8/1996 Held ..... 102/492

FOREIGN PATENT DOCUMENTS

| | | |
|---|---|---|
| DE | 1 453 815 A | 2/1969 |
| FR | 2 678 723 A1 | 1/1993 |
| FR | 2 679 640 B1 | 1/1993 |
| FR | 2 748 102 B1 | 10/1997 |
| FR | 2 778 978 A1 | 11/1999 |
| GB | 2 318 631 A | 4/1998 |

* cited by examiner

*Primary Examiner*—Harold J. Tudor
(74) *Attorney, Agent, or Firm*—Oliff & Berridge, PLC

(57) ABSTRACT

A fragmentation explosive munition element comprising a casing capable of generating fragments, having an axis of revolution, an explosive charge surrounded by the casing having the same axis of revolution and comprising a hole in the form of a cylindrical canal, the generatrices of which are parallel to the axis of revolution of the charge, a single peripheral and punctual means of initiating the charge. A design of this type makes it possible, for a given explosive charge, to obtain a markedly higher fragment velocity that is obtained with known designs.

9 Claims, 1 Drawing Sheet

FRAGMENTATION EXPLOSIVE MUNITION ELEMENT

Figure 1:
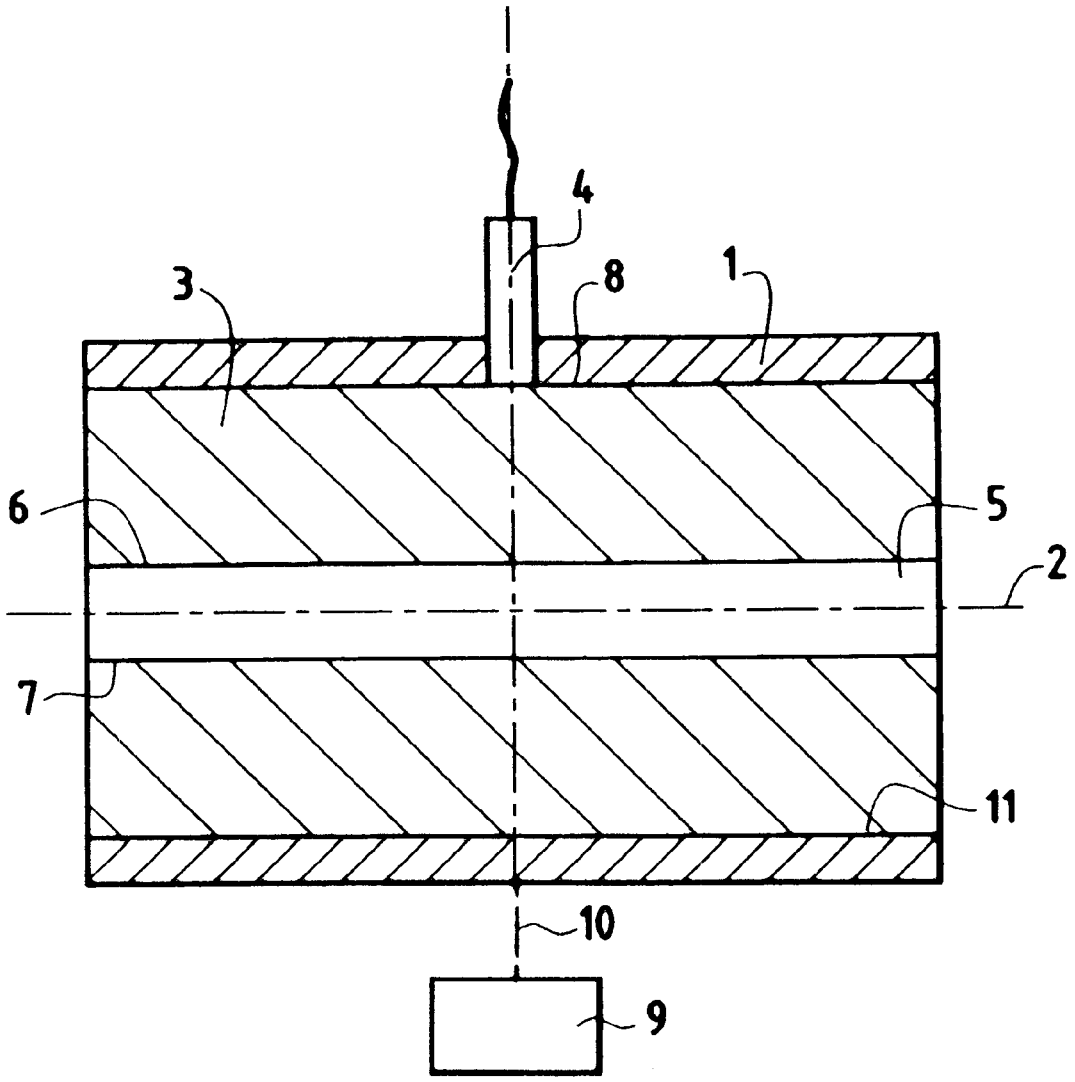

The present invention falls within the military domain, more specifically the domain of fragmentation explosive munitions, such as, in particular, bombs, with controlled or uncontrolled fragmentation, intended for example for anti-runway, anti-bunker or anti-vehicle (ship, tank, armoured vehicle, etc.) operations.

Fragmentation explosive munitions generally comprise a metal casing, prefragmented or otherwise, containing an explosive charge.

When the charge is detonated, the casing breaks, forming fragments whose destructive effects are desired. The higher the level of velocity of the fragments, the more intense these effects are.

It is well known for this velocity to be increased by using more powerful explosives, but these prove to be more expensive and more sensitive and therefore more dangerous to handle and to store.

The person skilled in the art therefore is on the constant look-out, in order to improve the effectiveness of fragmentation explosive munitions, particularly bombs, for a given explosive charge, for new designs, particularly architectures, that will make it possible to increase the velocity of the fragments obtained.

The present invention proposes such a solution.

Its subject is a novel fragmentation explosive munition element which comprises:

a casing, preferably metallic, capable of generating fragments, having an axis of revolution, an explosive charge contained in the said casing and covered by it, that is to say surrounded by the said casing, having the same axis of revolution as the casing, and comprising a hole in the form of a cylindrical canal, the generatrices of which are parallel to the axis of revolution of the explosive charge, a single means of initiating the said explosive charge.

This novel munition element according to the invention is characterized in that the single initiating means is a peripheral and punctual initiating means, that is to say one located at a single point on the surface of revolution of the explosive charge.

A "single" initiating means is normally to be understood as meaning that the explosive charge has no other means of initiation.

A "surface of revolution" is to be understood conventionally as meaning a surface generated by rotating a curve (generatrix) about a fixed straight line (axis of revolution).

The "generatrices" of the cylindrical canal are to be understood conventionally as meaning the collection of parallel straight lines sitting on a closed plane curve (directrix) defining a cylinder.

This new design according to the invention is not to be interpreted in its strictest mathematical sense. The canal may in particular simply be cylindroid, and the generatrices may simply be approximately parallel to the axis of revolution of the charge, which itself may not be strictly of revolution.

Various ways of initiating fragmentation explosive munitions are described in the prior art.

Patent FR 2 778 978 describes, for example, a fragmentation artillery round comprising an explosive charge contained in a casing. Initiation of the charge is either centrally in the explosive charge, or on the bottom side.

Patent FR 2 748 102 describes a fragmentation munition the explosive charge of which comprises a cylindrical central canal in which the means of initiating the charge is housed.

Patent GB 2 318 631 describes an explosive munition cylindrical element consisting essentially, on the one hand, of a hollow annular steel wall in which an explosive charge is embedded and, on the other hand, a multi-point system for initiating the explosive charge.

Patent FR 2 679 640 describes multi-point initiation apparatus intended to constitute a detonation-wave shaper for shaped or fragmentation charges.

The explosive charge has no hole in the form of a cylindrical canal.

U.S. Pat. No. 4,579,059 describes a tubular fragmentation projectile, the (hollow) wall of which delimits an annular chamber containing an explosive charge which is thus completely embedded in the tube.

Furthermore, the means of initiating the charge lies at a side face of this charge rather than at its periphery.

The abovementioned design according to the invention is therefore not known to those skilled in the art. Unexpectedly and in a particularly simple and inexpensive way, it makes it possible to increase considerably, for a given explosive charge, the velocity of the fragments obtained, without increasing the pyrotechnic risks associated with handling and storage.

According to a particularly preferred alternative form of the invention, the casing revolution capable of generating fragments and the explosive charge of revolution that it surrounds have a cylindrical or ogival shape. As example of other shapes of revolution, mention may be made of conical and frustoconical shapes.

According to the invention, the term "punctual" or "point" is not to be interpreted in the strictest mathematical sense. In practice, this term means a small area likenable to a point by comparison with the total area of revolution of the charge. A conventional initiating means comprising a detonator and a cylindrical relay of diameter 10 mm in explosive of the hexowax type in contact with the periphery of a charge of diameter 150 mm and of length 100 mm allows punctual peripheral initiation within the meaning of the present invention.

The firing of a perforating steel ball represents another example of a punctual initiating means according to the invention.

In general, use may be made of any conventional initiation means well known to those skilled in the art, particularly of initiation systems involving an explosive booster or a projected element.

According to the invention, the transition to detonation after initiation may be of the shock-to-detonation transition (SDT) type or of the delayed detonation transition type also known as "unknown"-to-detonation transition (XDT) type). These two mechanisms for transition to detonation are well known to those skilled in the art.

In SDT transition, initiation generates a shockwave whose pressure and sustain time level exceed the detonation threshold of the energetic material which is a characteristic of this material.

In the XDT transition, which lasts far longer, initiation generates a shockwave whose pressure and sustain time level are below the aforementioned SDT operating threshold. This rather unreactive shock physically damages the material, then, having reflected off the wall and combined with another wave, returns as a raised pressure to the damaged material, which causes it to break down chemically and to detonate.

The person skilled in the art knows, by calculation or by experiment, how to choose an initiation means that, for a given explosive charge, makes it possible to obtain a detonation transition of the SDT or XDT type.

According to a particularly preferred alternative form of the invention, the single initiating means is such that it can bring about an XDT transition by generating a shockwave whose pressure and sustain time level are below the detonation threshold of the explosive charge (SDT operation threshold).

Particularly unexpectedly, it has been found that this alternative form makes it possible to increase the velocity of the fragments obtained still further by comparison with the alternative form of initiation with SDT detonation transition.

According to another preferred alternative form of the invention, the hole in the form of a cylindrical canal is situated in the charge in a central position so that the axis of revolution of the explosive charge passes through the hole.

According to another preferred alternative form, the cross section of the cylindrical canal forming the hole is circular, elliptical, square, rectangular, trapezoidal, polygonal or star-shaped.

As a particular preference, the hole is a canal which is cylindrical of revolution, that is to say that its cross section is circular, the axis of which coincides, strictly or approximately, with the axis of revolution of the explosive charge.

The ratio between the cross section of the explosive charge and the cross section of the hole is preferably and in general between 5 and 100.

The hole in the form of a cylindrical canal may pass through the explosive charge, that is to say have two openings, which is preferred, but it may also have just one single opening, at the bottom end or front end of the charge, or may alternatively have no opening, that is to say is then trapped inside the charge.

The hole in the explosive charge is preferably empty of any material, that is to say preferably contains just air or any gas, but it may also at least partially contain a low-density inert material.

"Low" density is to be understood as meaning a density markedly lower than that of the energetic material of which the explosive charge is made, that is to say less than about 70% of the density of the energetic material.

As examples of such low-density inert materials, mention may be made of foams and rubbers with a density of between about 0.1 g/cm$^3$ and about 1.3 g/cm$^3$.

According to the invention, the explosive of which the charge is made may be any explosive well known to those skilled in the art in the domain of fragmentation munitions. This explosive is generally and preferably a solid, but may also, for example, be a viscous liquid. In this case, the hole in the form of a cylindrical canal must of course be embodied by a solid casing, for example a metallic one.

Composite explosives are particularly preferred by way of solid explosives, that is to say explosives obtained from explosive compositions with a plastic binder processed by casting followed by polymerization, consisting of a filled plastic binder containing at least one nitrogen-containing organic explosive such as hexogen or octogen.

By way of examples of other solid explosives which are particularly suitable in the context of the present invention, mention may be made of molten cast explosives such as those based on TNT (hexolite, octolite, etc.) and explosives with a plastic binder processed by compression.

Another subject of the present invention is a method for increasing the velocity of the fragments obtained from detonation of a fragmentation explosive munition element comprising:

a casing capable of generating fragments, having an axis of revolution, an explosive charge surrounded by the said casing, having the same axis of revolution as the casing and comprising a hole in the form of a cylindrical canal, the generatrices of which are parallel to the axis of revolution of the explosive charge.

This novel method according to the invention is characterized in that the detonation results from an initiation of the explosive charge located only at the periphery of the explosive charge, at a single point.

As a preference, according to this novel method, the means of initiation is such that it gives rise to a detonation transition of the XDT type, that is to say that the initiation of the explosive charge generates a shockwave whose pressure and sustain time level are below the detonation threshold of the explosive charge.

The appended FIG. 1 depicts a schematic section through a fragmentation explosive munition element according to the invention.

In the embodiment depicted schematically in FIG. 1, the munition element comprises:

a solid cylindrical metallic casing 1 capable of generating fragments, having an axis of revolution 2, an explosive charge 3, contained in the said casing 1 and covered by the said casing 1. This explosive charge 3 is therefore cylindrical and has the same axis of revolution 2 as the casing 1. The explosive charge 3 comprises, over its entire length, a hole 5 in the form of a cylindrical canal the generatrices 6, 7 of which are parallel to the axis of revolution 2 of the explosive charge 3, and the wall of which consists of the explosive charge 3. The hole 5, which passes through the explosive charge 3, is a canal which is cylindrical of revolution and the axis of which coincides with the axis of revolution 2 of the explosive charge 3.

a single means 4 of initiating the explosive charge 3, allowing the charge to be initiated peripherally at a single point.

An experimental device 9, not detailed in FIG. 1 and well known to those skilled in the art, makes it possible, using a slot scanning camera, to view the phenomena and effects produced once the charge has been initiated, and in particular makes it possible to determine the type of detonation transition and the velocity of the fragments obtained. The axis of the slot lies approximately along the axis of initiation 10 on the opposite side of the munition element from the initiation.

The following non-limiting examples illustrate the invention and the advantages it affords.

EXAMPLE 1

A fragmentation explosive munition element as depicted diagrammatically in FIG. 1, and with a length of 100 mm, was made.

The casing 1 was smooth, made of steel, 1.5 mm thick.

The outside diameter of the explosive charge 3 was 150 mm.

The diameter of the hole 5 was 50 mm.

The energetic material of which the explosive charge 3 was made was a composite explosive consisting of 55% by weight of octogen, 12% by weight of ammonium perchlorate, 3% by weight of aluminium and 30% by weight of a cross-linked energetic polymeric matrix obtained by polymerization, by hexamethylene diisocyanate biuret (BTHI), of a diethylene glycol polyadipate in the presence of an energetic plasticizer consisting of a mixture of nitroglycerine and butanetriol trinitrate.

The hole 5 was obtained in the conventional way using a central core positioned in the mould prior to the pouring in of the unpolymerized explosive composition.

The initiating means 4 comprised a conventional high-voltage detonator well known to those skilled in the art and a cylindrical relay made of hexowax (95% hexogen and 5% wax) of a diameter of 10 mm and height of 10 mm, in good contact with the surface of revolution of the explosive charge 3, by virtue of a perforation of a corresponding diameter in the casing 1.

After initiation it was possible, using the experimental device 9, to observe:

a detonation transition mechanism of the SDT type.

practically hemispherical expansion of the steel casing 1.

a rise rate of the casing 1 as a function of time, measured at the generatrix 11 opposite the generatrix 8 on which initiation occurred, making it possible to deduce an initial fragment velocity of 2870 m/s.

EXAMPLE 2

A fragmentation explosive munition element identical to the one of Example 1, but without the detonator, the hexowax relay and the corresponding perforation in the casing 1, was made. Peripheral initiation of the explosive charge was achieved by firing, towards the periphery of the casing 1, with a firing angle of 90° with respect to the plane of tangency of the point of impact, that is to say along the initiation axis 10 on the opposite side of the munition element from the experimental device 9, a perforating ball of PF1 type steel with a diameter of 12.7 mm, at a velocity of 1000 m/s.

This perforating ball represented the single means of initiation 4 according to the invention and according to FIG. 1.

There were observed, using the experimental device 9, a detonation transition mechanism of XDT type, expansion of the casing 1 which in qualitative terms was identical to the one observed in Example 1 but in quantitative terms was higher because the curve of casing rise speed as a function of time made it possible to deduce an initial fragment velocity of 3370 m/s.

COMPARATIVE EXAMPLE

This comparative example does not form part of the invention. It was performed solely with a view to demonstrating clearly the advantages afforded by the invention and, in particular, the significant gain achieved in initial fragment velocity.

According to this comparative example, a fragmentation explosive munition element strictly identical to the one of Example 2 was first of all made.

After conventional planar initiation of the explosive charge at one of the two planar faces, using a plane wave generator (PWG) coupled to a relay made of hexowax 95/5 with a diameter of 10 mm and a height of 10 mm itself coupled to a conventional high-voltage generator, a detonation transition mechanism of the SDT type and an initial fragment velocity of 2400 m/s were found.

The resulting gain in initial fragment velocity according to the invention is therefore of the order of 20% according to the configuration covered by Example 1 and of the order of 40% according to the configuration covered by Example 2.

What is claimed is:

1. A fragmentation explosive munition element, comprising:

an explosive charge, having a peripheral surface and opposing ends, the explosive charge having a hole in the form of a cylindrical canal, parallel to an axis of revolution of the explosive charge;

a fragment-generating casing surrounding the peripheral surface of the explosive charge, having an axis of revolution;

a single means of initiating the explosive charge, wherein the single initiating means is located on the peripheral surface of the explosive charge.

2. The explosive munition element according to claim 1, wherein the fragment-generating casing and the explosive charge have a cylindrical shape.

3. The explosive munition element according to claim 1, wherein the hole is situated in a central position so that the axis of revolution of the explosive charge passes through the hole.

4. The explosive munition element according to claim 1, wherein the hole is coaxial with the explosive charge.

5. The explosive munition element according to claim 1, wherein the hole passes completely through the explosive charge.

6. The explosive munition element according to claim 1, wherein the ratio between the cross section of the explosive charge and the cross section of the hole is between 5 and 100.

7. The explosive munition element according to claim 1, wherein the initiating means is such that it can generate a shockwave whose pressure and sustain time level are below the detonation threshold of the explosive charge.

8. A method for increasing the velocity of the fragments obtained from detonation of a fragmentation explosive munition element comprising an explosive charge, having a peripheral surface and opposing ends, the explosive charge having a hole in the form of a cylindrical canal, parallel to an axis of revolution of the explosive charge; a fragment-generating casing surrounding the peripheral surface of the explosive charge; a single means of initiating the explosive charge, wherein the single initiating means is located on the peripheral surface of the explosive charge, comprising: detonating the explosive charge at a single point on a periphery of the explosive charge.

9. The method according to claim 8, wherein the initiation of the explosive charge generates a shockwave whose pressure and sustain time level are below the detonation threshold of the explosive charge.

* * * * *